US006447182B2

(12) United States Patent
Brewington et al.

(10) Patent No.: US 6,447,182 B2
(45) Date of Patent: Sep. 10, 2002

(54) DUPLEX CHECK PRINTER USING A PRINT MECHANISM PIVOTED BETWEEN DOCUMENT PATHS

(75) Inventors: James Gabriel Brewington, Raleigh, NC (US); Stacy Leigh Bongrazio, Tabernacle, NJ (US); Richard Hunter Harris; Jeff David Thomas, both of Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/834,246

(22) Filed: Apr. 12, 2001

Related U.S. Application Data

(62) Division of application No. 09/477,161, filed on Jan. 4, 2000, now Pat. No. 6,296,405.

(51) Int. Cl.[7] ..... B41J 3/60

(52) U.S. Cl. ..... 400/188; 400/150; 271/65; 271/186

(58) Field of Search ..... 400/188, 174, 400/175, 149, 150, 578, 582, 619, 642; 347/215, 217, 218; 271/65, 184, 185, 186; 235/2–3, 17

(56) References Cited

U.S. PATENT DOCUMENTS 4,726,697 A * 2/1988 Maedge et al. ..... 400/625
5,080,513 A * 1/1992 Clary ..... 400/591

* cited by examiner

*Primary Examiner*—Andrew H. Hirshfeld
*Assistant Examiner*—Minh Chau
(74) *Attorney, Agent, or Firm*—J. Bruce Schelkopf; Ronald V. Davidge

(57) ABSTRACT

A printer for printing on both sides of a document includes first printing document guides, through which a document is driven for printing on a first side of the document, second printing document guides, through which the document is driven for printing on a second side of the document, and transfer document guides, into which the document is driven between motions within the first and second printing document guides, with a deflector determining the printing document guide into which a document is driven from the transfer document guides. A print head is pivotally mounted between the printing document guides, being pivoted between a position adjacent the first printing document guides and a position adjacent the second printing document guides.

3 Claims, 2 Drawing Sheets

DUPLEX CHECK PRINTER USING A PRINT MECHANISM PIVOTED BETWEEN DOCUMENT PATHS

CROSS-REFERENCE TO RELATED APPLICATIONS

This is a divisional application of filed co-pending parent application serial number 09/477,161, now U.S. Pat. No. 6,296,405 filed with the United States Patent and Trademark Office on 01/04/2000, the teachings of which are incorporated herein by reference.

BACKGROUND OF THE INVENTION

1. Field of the Invention

This invention relates to a means for printing on both sides of a paper document, and, more particularly, to printing automatically on both sides of a check at a point of sale terminal with a single print mechanism.

2. Description of the Related Art

In continuing attempts to provide more efficient and convenient service to customers, many retailers have begun to use "point of sale check printers" to reduce the time required for a customer to fill out and sign a check. Such a printer automatically enters the date, amount of purchase, and the name of the retail establishment, to which payment is being made, in the corresponding spaces of a check provided by the customer. The signature line is left blank, for the customer to sign after he has been presented with the printed check.

Another form of printing performed on a check by the retailer is the printing of franking information on the reverse side of the check. This information generally indicates that the check is for deposit only or that it is to be deposited only to a particular account. While it is not necessary to perform this printing operation at the point of sale, many retail establishments have a policy of printing this information, with a rubber stamp if necessary, at the point of sale, reducing the possibility of unrecoverable losses from checks stolen without franking information, which are later stamped or printed with forged information. It is therefore desirable for a point of sale check printer to be able to print on both sides of the check, with the amount of the check and the name of the retail establishment being printed on the front side of the check, and with the franking information being printed on the reverse side.

One method for printing on both sides of a check simply places an additional burden on the cashier using the point of sale terminal. The check is inserted into the printer for printing on a first side, removed, turned over, and then inserted into the printer for printing on the second side. While this method is the simplest in terms of the hardware required, the additional operations required to be performed by the cashier increase the time required for a transaction while also reducing the chance that the printing operation will be performed correctly. U.S. Pat. No. 5,553,817 provides an example of a printer configured for this type of operation, being capable of printing in either direction, across the width of a document, as needed for printing the franking information, or along its length, as required for printing information on the front side of a check. What is needed in this printer is a way for moving the document so that printing can occur on both sides without removal and reinsertion.

Some printers, such as the printer described in U.S. Pat. No. 5,558,449, provide for printing on both sides of a sheet of paper with two separate print mechanisms, operating on opposite sides of the sheet of paper. However, this approach naturally increases the complexity of the printer mechanism while tending to reduce its reliability.

U.S. Pat. No. 4,561,352 describes apparatus for printing on either side of a document, but not on both sides, in a single pass of the document through the apparatus. This apparatus is configured to print on envelopes, with the operator viewing the information on the front of the document, and with the apparatus then printing information keyed by the operator, such as a bar code representing the zip code or a routing code, on either the front or the back of the envelope. The print module includes two parallel document paths and a print head between the document paths. The print module is manually positioned between a first position, in which first document path is aligned with input and output paths of the apparatus, with the print head facing the first document path, and a second position, in which the second document path is aligned with the input and output paths of the apparatus, with the print head facing the second document path. A rack moving with the first and second document paths causes the print head to rotate between positions facing each of the document paths as the print module is moved.

The apparatus of U.S. Pat. No. 4,561,352 is not well suited for many applications, such as the printing of checks at a point of sale terminal, because a means is needed for moving a document between the two document paths to print on both sides of the document in a single pass through the apparatus, and because the apparatus is too large to fit in available space.

U.S. Pat. No. 4,932,798 describes a thermal transfer printer for printing on both sides of a document, which is carried past a print head while lying against a partial circumference of a print roller. In a first printing operation, a document fed from an input stack is printed on a first side and pulled through a 180-degree angle in contact with the print roller to be driven along a sheet seating surface. In a second printing operation, the document is fed from the sheet seating surface to be printed on the second side as it is again pulled through a 180-degree angle in contact with the print roller. A deflector plate is lowered so that, as the second printing operation is being completed, the document is fed into an output tray instead of being driven along the sheet seating surface.

U.S. Pat. No. 5,677,722 describes a thermal transfer printer capable of printing on both sides of a document. The printer includes first and second transferring rollers, first and second guide paths, and a paper-ejection path. The document is repositioned for printing on the reverse side, after the front side is completely printed by moving the document backward around a loop, with the document being driven through a 180-degree angle before it is again moved past the print head.

U.S. Pat. No. 5,746,526 describes a printer having a paper path feeding paper from a hopper along a "U"-shaped transport path formed of a first linear path, a curved path, and a second linear path. The print head prints on a front surface of the paper as it moves along the first linear path. Then the print head withdraws to a position adjacent the second linear path, from which the print head prints on the back surface of the paper.

U.S. Pat. No. 5,865,547 describes a print head and check flipper subassembly having a removable flipper cartridge to allow printing on both sides of a check or other document in one continuous operation. A check is fed downward, between a print head and platen, with printing occurring on a first side of the check, and into a loop within the flipper cartridge. The check continues around the loop, and is driven out of the loop, having been reversed front to back by being driven through a 180-degree angle in the loop. The check is fed upward between the print head and platen, with printing occurring on a second side of the check, and outward through the slot into which it has been inserted. This patent also describes the use of a Magnetic Ink Character Recognition (MICR) reader to read the characters extending along the lower edge of the check to determine the customer's bank and his account number.

A problem with the apparatus of U.S. Pat. Nos. 4,932,798, 5,677,722, 5,746,526 and 5,865,547 arises from the fact that the document must be driven through a 180-degree angle in a relatively tight loop before printing on the reverse side. Moving a document, such as a check, through such a large angle increases the chance that the document may become distorted, damaged, or jammed within the document path during the printing process. For example, when a document is driven through such a large angle, if one of the document edges extending along the document path moves at a faster speed than the opposite such document edge, the document becomes angularly misaligned in a manner which may cause information subsequently printed on the document to be misaligned and which may cause a paper jam or damage to the document. What is needed is a method for printing on both sides of a document while reducing the angle through which the document is bent as it travels through the document path.

BRIEF SUMMARY OF THE INVENTION

In accordance with a first aspect of the present invention, a printer for printing on both sides of a document includes first printing document guides, second printing document guides, transfer document guides, a print head, and a number of rollers. The document is moved along the first printing document guides for printing on a first side of the document and along the second printing document guides for printing on the second side of the document. Depending on the version of the printer, the first side of the document can be the front or back side thereof. The print head is disposed between the first and second printing document guides, being pivoted between a first printing position in which the print head is disposed to print on the first side of the document moving within the first printing document guides, and a second printing position in which the printed head is disposed to print on the second side of the document moving within the second printing document guides. The deflector is disposed between the transfer document guides and the printing document guides, being moved between a first deflector position, in which the document is moved between the first printing document guides and the transfer document guides, and a second deflector position, in which the document is moved between the transfer document guides and the second printing document guides. The number of rollers are driven to move the document along the document guides.

DETAILED DESCRIPTION OF THE INVENTION

Figure 1:
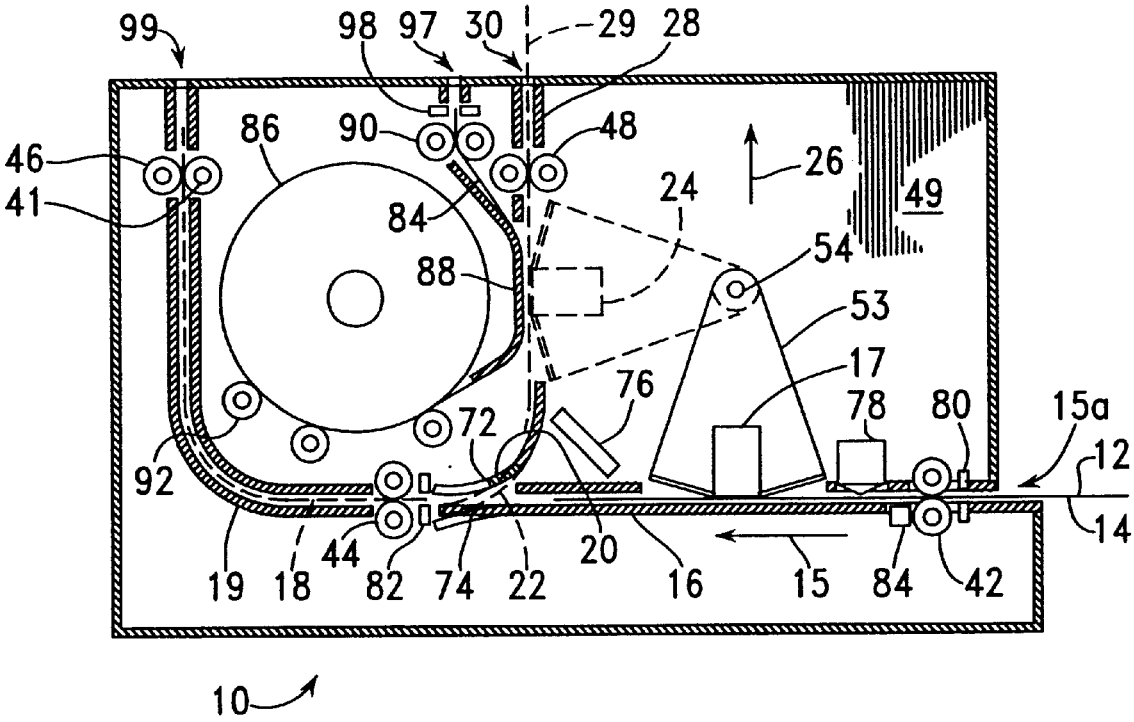
FIG. 1 is a longitudinal cross-sectional view of a duplex printer built in accordance with a first embodiment of the present invention.

FIG. 1 is a longitudinal cross-sectional view of a duplex printer 10, built in accordance with a first embodiment of the present invention. The duplex printer 10 prints a front side 12 of a check 14, as the check 14 is fed in the direction of arrow 15 into an input slot 15*a*, through first printing document guides 16, past a print head 17, and into the position indicated by dashed lines 18 within transfer document guides 19, with a deflector 20 being held upward to provide for free movement of the check 14 in either direction between the input document guides 16 and the transfer document guides 19. After printing on the front side 12 of the check 14 is completed, the deflector 20 is lowered into a position indicated by dashed lines 22, and the print head 17 is rotated into a position indicated by dashed lines 24. Next, the check 14 is driven upward, in the direction of arrow 26 through second printing document guides 28, while the back side of the check 14 is printed by the print head 17 in the position indicated by dashed lines 24. This upward movement of the check 14, through a position indicated by dashed lines 29, finally causes the check to be ejected through a first output slot 30.

Figure 2:
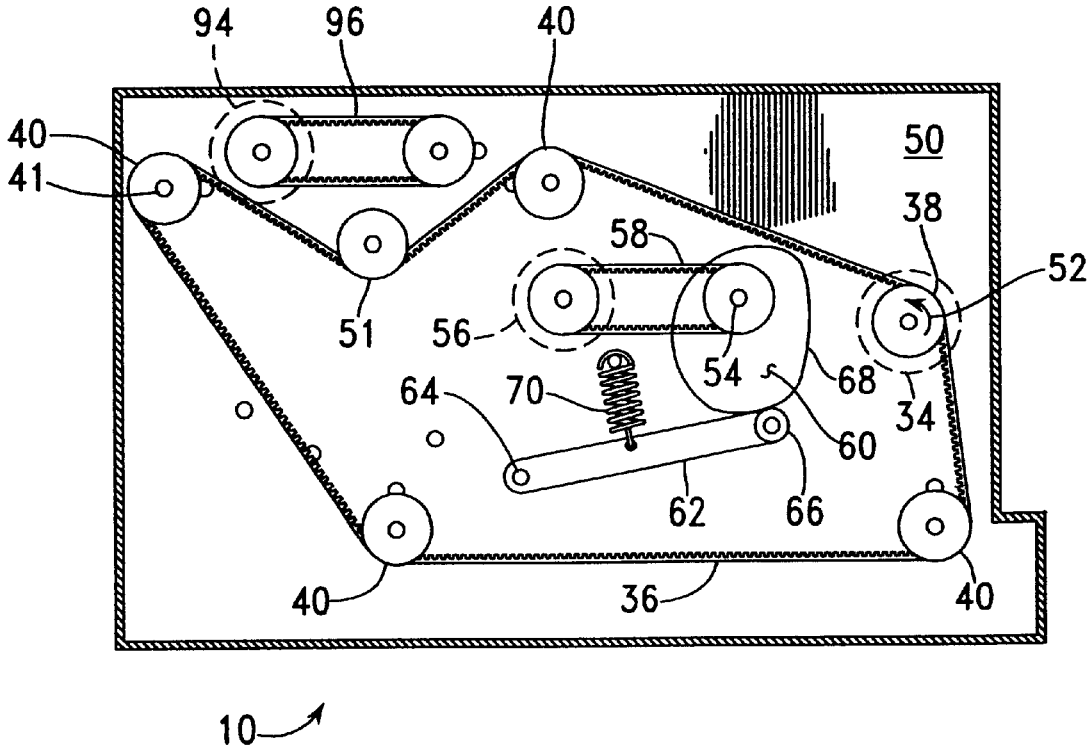
FIG. 2 is a left elevation of the duplex printer of FIG. 1, shown with a left cover removed to reveal drive mechanisms.

FIG. 2 is a left elevation of the of the duplex printer 10, shown with a left cover removed to reveal drive mechanisms.

Referring to FIGS. 1 and 2, the check 14 is moved through the printer 10 by means of a document drive motor 34, driving a toothed document drive belt 36 by means of a toothed drive pulley 38. The document drive belt 36 in turn causes driven pulleys 40 to rotate. These driven pulleys 40 are individually attached to shafts 41 extending from first printing drive roller 42, from a first transfer drive roller 44, from a second transfer drive roller 46, and a second printing drive roller 48. The shafts 41 are rotatably mounted within a right sideplate 49 and a left sideplate 50. The various document guides 16, 19, 28 also extend between the sideplates 49, 50. The document drive belt 36 also extends around an adjustable idler pulley 51, which is positioned to provide a suitable level of tension within the belt 36.

When the document drive motor 34 is operated to turn the drive pulley 38 in the direction of arrow 52, each of the driven pulleys 40 is also driven in. the direction of arrow 52 by means of the drive belt 36, so that a check 14 is driven in the direction of arrow 15 within the first printing document guides 16 and within the transfer document drive guides 19. On the other hand, when the document drive motor 34 is operated to turn the drive pulley 38 opposite the direction of arrow 52, each of the driven pulleys 40 is also driven opposite the direction of arrow 52, so that a check 14 in the position indicated by dashed lines 18 is moved opposite the direction of arrow 15 within the transfer document guides 19 and upward within the second printing document guides 28.

The document drive motor 34 is preferably a stepper motor which is driven by a signal which is analyzed to determine the position of the check 14 in cooperation with signals provided from position detectors 80, 82. In this way, a determination is made of the location of the edges of the check 14, so that the check 14 can be accurately and reliably driven through the document guides 16, 19, 28. Also, the signal driving the document drive motor 34 is used to determine where characters are printed on each side of the check 14.

The print head 17 is preferably an ink-jet type including a single line of nozzles extending across the width of the check 14. Such a print head can form characters in any orientation and in any place on the check 14 as the check 14 is moved in a longitudinal direction past the print head 17. An example of such longitudinal motion of the check 14 past the print head 17, in the position in which it is shown, is found in the movement of the check 14 in the direction of arrow 15.

The print head 17 is attached, by means of a bracket 53, to a pivot shaft 54, which is rotatably mounted within the sideplates 49, 50, and which is rotated by means of a print head rotating motor 56 through a belt drive 58. A deflector drive cam 60 is also connected to the document drive shaft 54 to turn with the print head 17. A cam follower 62 and the deflector 20 are both mounted to pivot with a shaft 64, with a cam follower roller 66 being held in contact with a peripheral surface 68 of the cam 60 by means of an extension spring 70. With the print head 17 in the position in which it is shown, the peripheral surface 68 holds the roller 66 downward, so that the deflector 20 is held upward, also in the position in which it is shown. When the print head 17 is rotated into the position indicated by dashed lines 24, roller 66 moves upward as the deflector 20 pivots downward, into the position indicated by dashed lines 22. The deflector 20 is preferably divided into several sections 72 which extend downward among several sections 74 extending from the first printing document guides 16.

The print head 17 can also be rotated into an intermediate position engaging a device 76 which is intermittently used to clean and cap the nozzles within the print head 17 in a manner well known to those skilled in the art of ink jet printing.

In accordance with a preferred version of the present invention, the duplex printer 10 is configured particularly for printing on both sides of a check 14 within a point of sale terminal, with a magnetic read head 78 being positioned to read the characters printed in magnetic ink along the front side of the check 14 near its lower edge These characters are provided in a particular MICR (Magnetic Ink Character Recognition) type style and are decoded by software running in a processor within, or in a system associated with, the duplex printer 10, to yield the customer's bank and account number. This information is preferably compared to a list of bank accounts corresponding to checks which have been stolen and may even be used to determine whether the customer has enough money in his bank account to cover the check being printed.

The processing of an individual check 14 in this application begins when the check 14 is place in the input slot 15*a*, in a predetermined orientation placing the magnetic ink characters on the check 14 are aligned with the magnetic read head 78. When a leading edge of the check 14 is placed in the input slot 15*a*, a position detector 80 provides an electronic signal indicating that the check 14 has been inserted. The position detector 80 may be a conventional device having a light source shining on a photodetector across a gap through which the check 14 is moved. When the check 14 blocks light directed at the photodetector, the output signal from the photodetector indicates the presence of a document. After an inserted check 14 is detected in this way, the document drive motor 34 is turned on to drive the check 14 in the direction of arrow 15, with rotation of the drive pulley 38 in the direction of arrow 52 until the check 14 is in the position indicated by dashed lines 18, by means of driven rollers 42, 44, 46. The distance through which the check is moved is determined either by the driving signal pulses applied to the document drive motor 24, by the number of such signal pulses occurring after the trailing edge of the check 14 passes the position detector 80, thus compensating for differences in the length of checks, or by the time at which the trailing edge of the check 14 passes an optional transfer position detector 82.

During this movement of the check 14, the magnetic ink characters are first magnetized as they are moved adjacent a permanent magnet 84 and are then read as they are moved by the magnetic read head 78. Also, information is printed on the front side 12 of the check 14, as the check 14 is moved by the print head 17. This information is, for example, on a first line, the name of the retail establishment to which the check is payable, and an amount of money to be paid, determined by a device within the point of sale terminal operating in the manner of a cash register. This information is, also for example, on a second line, this amount of money written out in words. Because the print head 17 is preferably an ink jet print head including nozzles extending across the width of the check 14, both of these lines can be printed at once, with one movement of the check 14 past the print head 17.

After the movement of the check 14 is stopped with the check 14 entirely within the transfer document guides 19, as indicated by dashed lines 18, the print head rotating motor 56 is turned on to move the print head 17 from the position in which it is shown to the position indicate by dashed lines 24. The simultaneous rotational motion of cam 68 causes the deflector 20 to be lowered into the position indicated by dashed lines 22.

Next, the document drive motor 56 is turned on to rotate the drive pulley 38 opposite the direction of arrow 52, so that the check 14 is moved opposite the direction of arrow 15 within the transfer document guides 19 and out of the printer 10 through the second printing document guides 28 and the output slot 30. This movement of the check 14 is accomplished using drive rollers 44, 46, and 48, all turning opposite the direction of arrow 52. During this movement of the check 14, franking information is printed in the back side of the check 14 by means of the print head 17 in the position indicated by dashed lines 24. The franking information is printed across the width of the check near an end of the check, indicating, for example, that the funds represented by the check should be deposited in an account of the establishment to which the check has been given. When the check 14 has been ejected through the output slot 30 the process of printing information on it has been completed.

A preferred version of the duplex printer 10 additionally includes additional means for printing information on a web 84 of paper pulled from a roll 86. These additional means include third print document guides 88, a web feeding roller 90, and a number of rollers 92 supporting the roll 86 while allowing it to turn. The web driving roller 90 is turned by a web drive motor 94 through a belt drive 96.

This web printing feature is used, for example to print a cash register receipt before printing the check 14. In this example, the format and information of the material printed on the web 84 is different from the information printed on the check 14. During the web printing process, the web 84 is pulled from the paper roll 86 by rotation of the web feeding roller 90, with printing occurring as the web 84 passes the print head 17 in the position indicated by dashed lines 24. When the printed receipt is driven outward through a second output slot 97, the rotational movement of web feeding roller 90 is stopped, and the individual receipt is cut from the web 84 by means of an electrically operated knife 98.

In an application printing receipts in this manner, the print head 17 is preferably left in the position indicated by dashed lines 24 between customers, to be ready for printing the receipt of the next customer. After a receipt is printed, if the customer wishes to pay by check, the check is printed, for example, with the total value of the receipt.

The duplex printer 10 may also be used to print on only one side of a check or other document by sending the document through the first printing document guides 16, with printing occurring as the document moves past the print head 17, in the position in which it is shown, and with the deflector 20 in the raised position in which it is shown. The document is driven through the transfer document guides 19 and outward through the second output slot 99.

Figure 3:
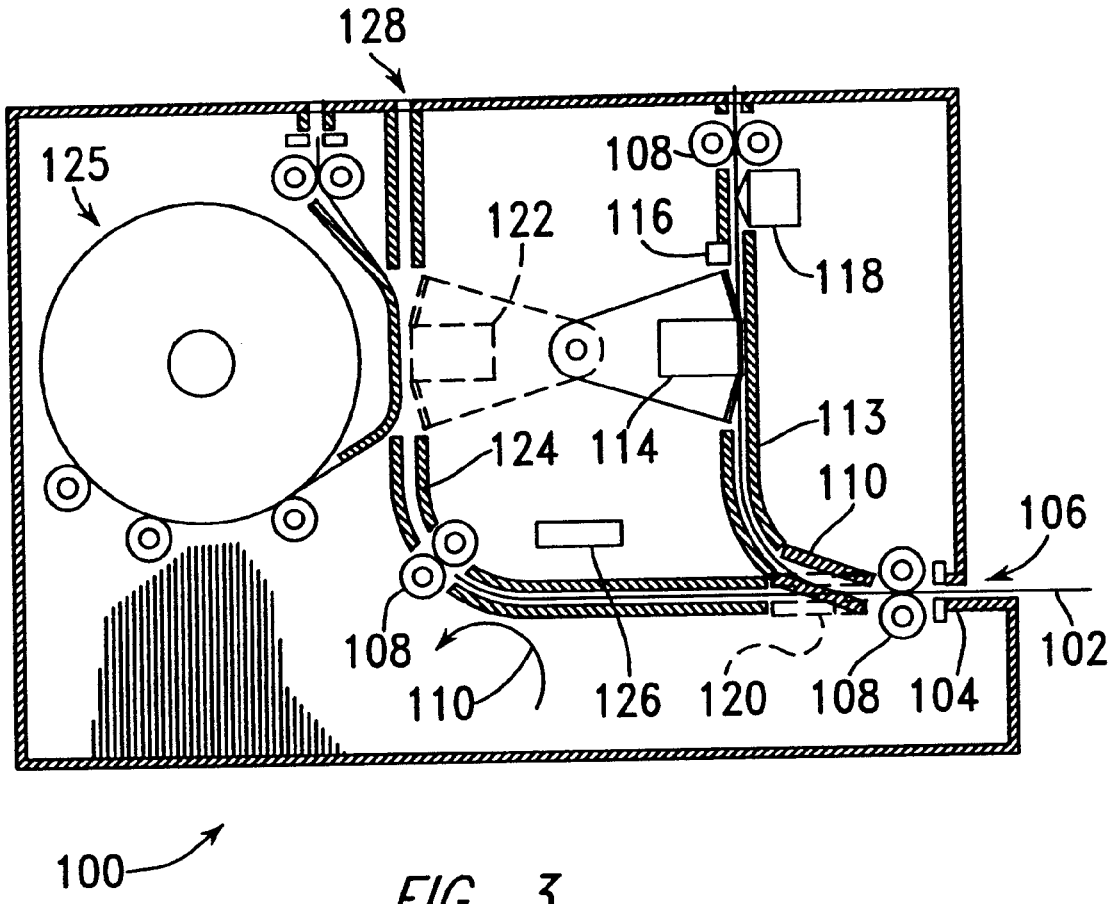
FIG. 3 is a longitudinal cross-sectional view of a duplex printer built in accordance with a second embodiment of the present invention.

FIG. 3 is a longitudinal cross-sectional view of a duplex printer 100 built in accordance with a second embodiment of the present invention. In this printer 100, the process of printing a check begins after the check 102 is inserted into transfer document guides 104 through an input slot 106. When a position detector 106 determines that the check 102 has been inserted in this way, a document drive motor (not shown) is turned on to rotate document drive rollers 108 in the direction of arrow 110. A deflector 112 is held in the position in which it is shown, so that the check 102 moves upward within first printing document guides 113. During this movement of the check 102, the characters printed on the check 102 with magnetic ink are magnetized during passage by a permanent magnet 116 and are read by a magnetic read head 118. Next, the document drive motor is turned on to rotate document drive rollers 108 opposite the direction of arrow 110, so that the check 102 moves downward within the first printing document guides 113. During this downward movement, the franking information is printed on the back side of the check 102 with the print head 114 in the position in which it is shown.

While the document drive motor and a mechanism for causing rotation of the print head 114 and the deflector 110 are not shown, it is understood that such devices are similar to corresponding devices shown in FIG. 2 and described in detail above. Like the print head 17 of FIG. 1, the print head 114 is preferably an ink-jet print head having a row of nozzles extending across the width of the check 102.

After the motion of the check 102 upward within the first printing document guides 113 is completed, the document drive motor (not shown) is operated to turn the document drive rollers 108 opposite the direction of arrow 110. These rollers 108 are used to drive the check 102 downward, so that the check 102 is stopped within the transfer document guides 104 with the trailing edge of the check 102 extending at 10 most partially within the deflector 110.

The deflector 110 is next lowered, into the position indicated by dashed lines 120, and the print head 114 is rotated into the position indicated by dashed lines 122. Then, the document drive motor (not shown) is again operated to drive the document feed rolls 108 in the direction of arrow 110, driving the check 102 upward through second printing document guides 124 and outward through an output slot 128. During this motion of the check, information is printed on the front side of the check by means of the print head 114, located in the position indicated by dashed lines 122.

A preferred version of this second embodiment 100 also includes a mechanism 125 for printing information on a web extending from a roll of paper. This mechanism operates as described in detail above in reference to FIGS. 1 and 2.

A preferred version of the second embodiment 100 also includes a station 126, to which the print head 114 is intermittently rotated for cleaning the nozzles of the print head.

In both of the duplex printers 10, 100, the deflectors 20, 110 and the print heads 24, 114 are preferably either returned to the position in which they are shown after a printing operation, to be ready for the insertion of a check, or the print heads and deflectors are left in the positions indicated by dashed lines to be ready to print a new receipt from a web.

While the document being printed within the duplex printers 10, 100 is generally called a check, with the printer 10, 100 being used as a point of sale printing terminal, it is understood that the printer 10, 100 can also be used to print on both sides of other kinds of documents, including blank paper.

While the duplex printers 10, 100 has been described in some detail as employing a print head 17 including a number of ink-jet nozzles extending across the width of a check 14, it is understood that other means, such as a wire matrix print head using a ribbon can alternately be used. For example, a printer having a slanted column of wires could be used to print information on the front of the check with longitudinal check motion, and with the print head being moved laterally between the locations in which individual lines are printed., and furthermore to print franking information on the back of the check with lateral motion of the print head, while the check is driven longitudinally between the lines to be printed, in the general manner described in U.S. Pat No. 5,533,817.

While the present invention has been described in its preferred versions or embodiment with some degree of particularity, it is understood that this has been done only by way of example, and that numerous changes, including changes in the arrangement of parts, may be made without departing from the scope of the invention.

What is claimed is:

1. A printer, for printing different information on a document and a paper web, comprising:

a print head including a plurality of ink jet nozzles;

web guides along which said paper web is moved past said print head;

first document guides along which said document is moved past said print head between said print head and said paper web for printing on a first side of said document.

paper supply guides for holding a roll of paper from which said web of paper is drawn;

a roller driven to move said web of paper along said web guides;

a knife cutting said web of paper into section after said print head prints on said web of paper, and second document guides, along which said document is moved for printing on a second side of said document, wherein said second document guides extend in a spaced-apart relationship with said first document guides, and wherein said print head is moved between a first position, in which said print head prints on said paper web and on said first side of said document, and a second position, in which said print head prints on said second side of said document.

2. A printing device, for printing different information on a document and a paper web, comprising:

at least one print head having one or more ink jet nozzles;

web guides along which said paper web is moved past at least one print head;

paper supply guides for holding a roll of paper from which said web of paper is drawn;

a roller driven to move said web of paper along said web guides;

a knife cutting said web of paper into sections after said print head prints on said web of paper;

a first document guide along which said document is moved along near at least one print head for printing on a first side of said document; and, a second document guide extending spatially in relation to said first document guide, along which said document is moved for printing on a second side of said document;

wherein at least one print head is moved between a first position, in which at least one print head prints on said paper web and on said first side of said document, and a second position, in which at least one print head prints on said second side of said document.

3. The device of claim 2, wherein said device is a printer.

* * * * *